US006968937B2

(12) United States Patent
Mader et al.

(10) Patent No.: US 6,968,937 B2
(45) Date of Patent: Nov. 29, 2005

(54) METHOD AND DEVICE FOR THE SUSPENDED TRANSPORT OF OBJECTS ON A TRANSPORT TRACK COMPRISING AN ACCUMULATED STORE

(75) Inventors: Carl Conrad Mader, Hinwil (CH); Erwin Muller, Dürnten (CH); Markus Felix, Richterswil (CH)

(73) Assignee: Ferag AG, Hinwil (CH)

( * ) Notice: Subject to any disclaimer, the term of this patent is extended or adjusted under 35 U.S.C. 154(b) by 332 days.

(21) Appl. No.: 10/332,302

(22) PCT Filed: Jun. 26, 2001

(86) PCT No.: PCT/CH01/00393

§ 371 (c)(1),
(2), (4) Date: Jan. 6, 2003

(65) Prior Publication Data

US 2003/0098219 A1 May 29, 2003

(51) Int. Cl.[7] ..... B65G 47/26
(52) U.S. Cl. ..... 198/419.1; 198/459.7
(58) Field of Search ..... 198/419.2, 419.3, 198/419.7, 465.4, 418, 418.7, 419.1, 459.7, 463.6

(56) References Cited

U.S. PATENT DOCUMENTS

| | | | | |
|---|---|---|---|---|
| 3,032,341 A | | 5/1962 | Reist | |
| 4,007,824 A | * | 2/1977 | Reist | 198/462.2 |
| 4,201,286 A | | 5/1980 | Meier | |
| 4,887,809 A | | 12/1989 | Eberle | |
| 4,892,186 A | | 1/1990 | Frei | |
| 5,072,822 A | | 12/1991 | Smith | |
| 5,971,131 A | | 10/1999 | Blattner et al. | |
| 6,321,896 B1 | * | 11/2001 | Zuccheri et al. | 198/419.1 |
| 6,357,574 B1 | | 3/2002 | Eberle et al. | |
| 6,464,067 B1 | * | 10/2002 | Reist | 198/465.4 |
| 6,554,126 B1 | * | 4/2003 | Muller | 198/465.1 |

FOREIGN PATENT DOCUMENTS

| | | |
|---|---|---|
| CH | 382 768 A | 12/1964 |
| GB | 966 402 A | 12/1960 |

OTHER PUBLICATIONS

WO 99/33731, Conveyor System, Publication Date: Jul. 8, 1999.

* cited by examiner

*Primary Examiner*—Richard Ridley
(74) *Attorney, Agent, or Firm*—Rankin, Hill, Porter & Clark LLP

(57) ABSTRACT

Holding elements (1) equipped for transporting individual articles (2) in a held manner and being movable along a stretch of rail (5) independently of one another at least to a limited extent and having in pushed operation a regular minimum distance between one another, are banked-up during transportation at a banking-up point by a banking-up device (16) to form an accumulation store (12) upstream of the banking-up point. The holding elements are released in groups from the accumulation store (12) in a controlled manner and are conveyed away from the accumulation store. The holding elements (1) in the groups (15) advantageously are spaced the minimum distance from one another. For pre-forming the groups to be released (12) there is a further banking-up device (16) provided in the accumulation store (12). The further banking-up device acts at a further banking-up point upstream of the first banking-up point. The stream of groups being conveyed away from the accumulation store (12) can be supplied without any further transformation steps to a unit, in which the groups of articles held by holding elements (1) are processed (e.g. stacked and packed).

26 Claims, 6 Drawing Sheets

METHOD AND DEVICE FOR THE SUSPENDED TRANSPORT OF OBJECTS ON A TRANSPORT TRACK COMPRISING AN ACCUMULATED STORE

BACKGROUND OF THE INVENTION

1. Field of the Invention

The invention is situated in the field of materials handling technology and it relates to a method and a device for transporting articles along a conveying track, wherein the articles are held individually and are transported along the conveying track one behind the other and at least to a limited extent independent of one another and wherein the articles pass through an accumulation store during the transportation along the conveying track.

2. Description of Related Art

Conveyance according to the manner mentioned above is known in particular for flat articles, such as newspapers and periodicals, from the publications DE-2822060 (or U.S. Pat. No. 4,201,286), CH-382768 (or U.S. Pat. No. 3,032,341) EP-0276409 (or U.S. Pat. No. 4,892,186), EP-0309745 (or U.S. Pat. No. 4,887,809) or WO-99/33731 (or U.S. Pat. No. 6,357,574). For such transport, each one of the flat articles is conveyed while being held by a holding element such that its principal surfaces are oriented substantially transverse to the conveying direction. The holding elements are movable individually and at least to a limited extent independently of one another along a stretch of rails and they are designed such that they can be driven pushing one another. The dimension of the holding elements parallel to the conveying direction is the same for all holding elements and is advantageously greater than the corresponding dimension of the articles (thickness of the flat articles), so that in pushed operation there are defined distances between holding elements (e.g. distance between the front ends of successive holding elements) or between articles held by the holding elements respectively, which distances in a given system are the smallest possible distances.

In comparison with conveying methods using holding means being arranged equidistantly on a single conveying organ, e.g. on a circulating chain, the conveying methods for flat articles as described in brief above has, inter alia, the following advantages: the distances between the holding elements can be changed locally and independent of one another by very simple means and in particular without transfer of the articles to other holding means; very dense and nonetheless very precisely arranged conveying streams can be formed; and conveying tracks can be designed as accumulation store devices in a very simple manner.

For the formation of an accumulation store, the holding elements are solely banked up along the conveying track, are released from the head of the banked up articles in a controlled manner, and are conveyed onwards. The group of banked up articles, which has a stationary head and a variable length, represents the accumulation store. For realizing such an accumulation store on a conveying track, drives (motor drives or the force of gravity) are to be provided for conveying holding elements with a constant or variable speed and with constant or variable spacings to the tail end of the accumulation store and with variable speed and minimum distances between one another through the accumulation store (supply drive and buffer drive), and for conveying holding elements to be released at the buffer head away from the accumulation store (conveying-away drive). Furthermore, means for banking up holding elements in the accumulation store for releasing them from the accumulation store and for transferring them to the conveying-away drive are to be provided.

Accumulation stores are utilized wherever a unit supplying articles and a unit taking over the articles are to be connected with one another in a flexible manner, such that the units can be operated with respect to their performance (measured in articles per unit of time) within wide limits without any mutual interdependences (uncoupled), and nonetheless without the necessity to take the articles out of a common process-order. When the performance of the unit supplying the articles is greater than that of the unit taking over the articles, the fill level of the accumulation store increases. When the performance of the unit supplying the articles is smaller than the performance of the unit taking over the articles, then the fill level of the accumulation store decreases.

In accordance with the prior art (refer to the publications mentioned above), accumulation stores on conveying tracks equipped for held and independent transportation of holding elements or of articles held by holding elements, respectively, the banking-up means or releasing means respectively comprise a timing wheel arranged at a stationary head of the store. This timing wheel comprises teeth adapted to the holding elements and in rotation it grasps with each of its teeth the respectively first holding element in the accumulation store, in order to separate it from the head of the accumulation store and to transfer it to the conveying-away drive. For a variable release performance (in holding elements or held articles per unit of time) the speed of rotation of the timing wheel is varied as required or the timing wheel is switched (predefined, non-variable speed or standstill).

SUMMARY OF THE INVENTION

The present invention is directed toward making transportation and buffering or accumulation as described above more flexible such that the stream of articles or holding elements conveyed away from the head of the accumulation store (with or without articles) can be adapted to a greater degree than is possible with methods and arrangements of the prior art to different conditions prevailing downstream. The application of the method and device according to the invention are to provide a conveying-away stream, which can be supplied directly to a unit imposing conditions on the conveying stream, i.e. if possible without any further transformation or else with a significantly reduced amount of further transformation. In comparison with the prior art, the method and device in accordance with the invention provides, in particular, an increased process density and a reduction in the length of conveying tracks necessary for conveying stream transformations such that conveying/accumulation substantially retain their characteristics, but can be arranged closer to a downstream unit taking over the articles and to the greatest extent can do without any further means for stream transformation.

The method according to the invention consists in essence of releasing and transferring holding elements (with or without held articles) from the buffer storage system to a conveying away-drive, not individually, but in groups. This means that instead of producing a stream of individual holding elements as is known from the prior art, a stream of holding element groups is produced. In the groups of the conveyed away stream, the holding elements have advantageously the minimum possible distance between one another the same as in the accumulation store or in pushed conveying operation. The distances between groups and the conveying away speed are optionally constant or variable as required and the number of holding elements in the groups is constant or variable. At the same time, the articles conveyed away from the head of the buffer are still held individually.

Obviously, when using the method according to the invention it is also possible to establish a conveying-away stream of holding element groups, in which every group comprises solely one holding element. In accordance with the prior art, only conveying-away streams of such a type can be established; according to the invention, which is directed to increased flexibility, establishing a conveying-away stream of the named kind is a special, possible case, for which, however, method and device are not particularly suitable.

The method and the device in accordance with the invention are suitable in particular for supplying groups of articles to units, in which articles are processed in tight groups, for example, are stacked or packed.

The holding element groups, which according to the method of the invention are released from the accumulation store and are transferred to the conveying-away drive, are pre-formed in the accumulation store, where the holding elements are already arranged with minimum distances between one another. In addition to the formation of groups, it is possible to implement further transformations in the accumulation store. Such transformations are aligned to conditions imposed on the conveying-away stream further downstream and comprise, for example, re-orientation of the articles, marking of the articles as members of a specific group, marking of articles as specific group members (e.g., a group member, which is arranged right at the front or right at the back of the group), or formation of sub-groups within the groups.

The device in accordance with the invention serving for serially transporting holding elements or articles held individually by holding elements along a conveying track comprises a plurality of holding elements movable one behind the other and at least partially independently of one another along a stretch of rail defining the conveying track. The device further comprises a supply drive for supplying holding elements to the tail end of an accumulation store, a buffer drive for transporting holding elements from the tail end of the accumulation store towards the head of the accumulation store, and a conveying-away drive for transporting holding elements away from the head, as well as a means for forming holding element groups in the accumulation store and a means for releasing holding element groups from the accumulation store and for transferring the groups to the conveying-away drive.

The force of gravity can be used at least partly as a supply drive, buffer drive, or conveying-away drive. The three drives can be designed as separate drives or as one or two drives, wherein at least one of the drives takes over more than one of the named drive functions. In the same manner, the functions of the named means for forming groups and for releasing and transferring groups can be taken over each respectively by a separate device part or else jointly by the same device part.

As already hinted at in the above sections, neither for the method according to the invention nor for the device in accordance with the invention it is of significance, whether the holding means in the supply stream, in the accumulation store, or in the conveying-away stream are holding articles. In most applications, either all holding elements will be loaded or all holding elements will be empty. However, applications with partially loaded and partially not loaded holding elements are also conceivable.

BRIEF DESCRIPTION OF THE DRAWINGS

The method according to the invention and different embodiments of the device in accordance with the invention are described in more detail in connection with the following figures, wherein.

DETAILED DESCRIPTION OF THE PREFERRED EMBODIMENTS

Figure 1:
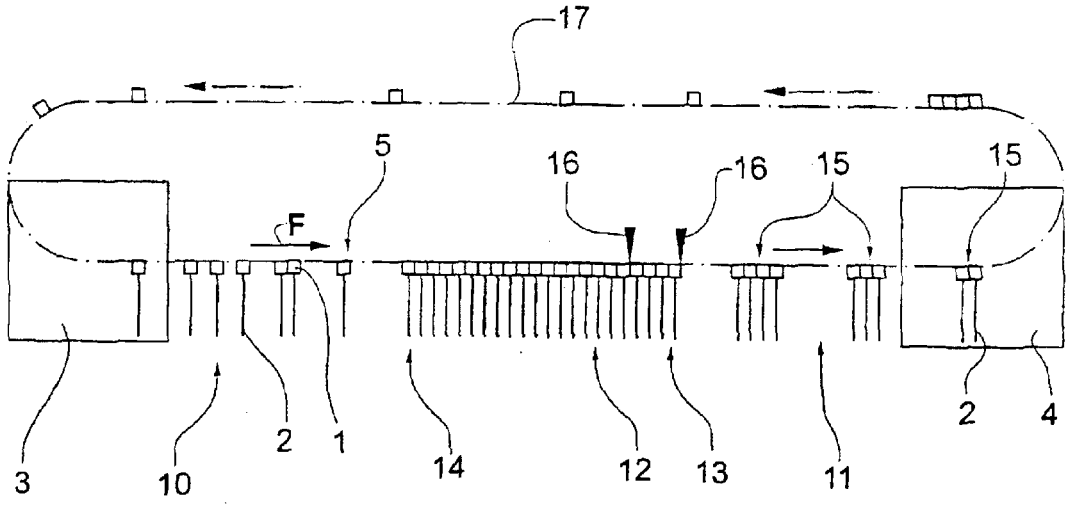
FIG. 1 shows the principle of the method according to the invention.

FIG. 1 is a schematic diagram of the principle of the method according to the invention. In accordance with this method, articles 2, e.g. flat articles, such as newspapers or periodicals are held individually by holding elements 1. The articles 2 are transported along a conveying track defined by a stretch of rails 5, for example, from a unit 3 supplying the articles to a unit 4 taking over the articles. The holding elements 1 are independent of one another, i.e. they are advantageously not connected to one another, or if so required are connected with one another through connecting elements having a variable length parallel to the conveying direction F. The holding elements 1 are roller bodies or sliding bodies, each one comprising a gripper for gripping an article 2. All holding elements 1 advantageously have the same, as small as possible, length parallel to the conveying direction such that pushed against one another they form a densely concentrated conveying stream with uniform distances between the grippers or between the articles held by the grippers, respectively.

The conveying track is functionally split-up into three parts: a supply track 10, a conveying-away track 11, and between supply track 10 and conveying-away track 11 an accumulation store 12 with a head 13 and a tail end 14, wherein the position of the head 13 on the conveying track is substantially constant and the position of the tail end 14 varies depending on the fill level of the accumulation store 10.

In accordance with the invention, the items released at the head 13 of the accumulation store 10 and transferred to the conveying away system are not individual holding elements 1 or individual held articles 2, but they are holding element groups 15. These groups 15 are pre-formed in the accumulation store 12 prior to their release. For forming the groups and releasing them at the head 13 of the accumulation store 10, two banking-up means 16 are arranged one behind the other in the conveying direction, in a manner that will be described in detail hereinafter.

As in the case of any buffering system, the supply performance (in holding elements per unit of time) on average has to be the same as the conveying-away performance. This condition, the maximum buffering capacity and, of course, also other characteristics of a specific device, impose limits regarding spacings and speeds of supply and conveying-away. Within these limits, spacing and/or speed of the supply are freely selectable. Regarding conveying-away, the spacing within the groups substantially corresponds to the minimum distance, while the distances between the groups are freely selectable. In the accumulation store 12 the distances are equal to the minimum distance and the speed is such that for every group release the corresponding group is present and pre-formed at the head of the accumulation store.

For the supply, the following variants are possible:

- speed variable and distances between holding elements constant (if so required with corresponding gaps);
- speed constant and distances between holding elements variable (if so required, in part also minimum distances: "groups");
- speed variable and distances between the holding elements variable;
- speed constant and distances between the holding elements constant (if so required with gaps).

For releasing the groups from the accumulation store and for conveying them away, for example, the following variants are possible (distances between groups are distances between the last and the first holding element of successive groups), wherein the groups may be of the same size or may comprise different numbers of holding elements:

- group release from the accumulator storage on request (distances in time between group releases variable) and conveying-away speed constant, which leads to variable distances between groups;
- group release regularly clocked (distances in time between group releases constant) and variable conveying away speed, which leads to variable distances between groups;
- group release regularly clocked and conveying away speed constant, which leads to constant distances between groups.

As still remains to be demonstrated, devices are particularly simple if the supply speed and the conveying-away speed are equal and also the same as the maximum accumulator speed. In this case, the device in accordance with the invention can be implemented with a single drive for supply, for accumulation store conveyance and for conveying-away, providing the drive is designed such that it slips relative to banked-up holding elements within the accumulation store, or such that holding elements banked-up within the accumulation store, are capable of being temporarily uncoupled from the drive. An example of a conveying system of this kind comprising a drive that runs continuously along the conveying track and to which the holding elements are magnetically coupled is, for example, described in the publication WO-99/33731.

In particular, for supply and accumulation store conveyance the force of gravity can be exploited instead of mechanical means, provided the conveying track is designed to be correspondingly sloping downwards. For the banking-up function, instead of an active banking-up means, another braking effect may be utilized. For example, the force of gravity along a climbing section of the rail stretch, friction between the rail stretch and the holding elements, or solely the momentary lack of a driving force (passive banking-up point).

The articles 2 are fed-in to the unit 3 supplying the articles, e.g. in an imbricated stream or individually, for example, from a storage unit (coil or roll, sheet feeder) to be taken over by the holding elements 1. In the unit 4 to which the articles are delivered, the articles 2 are, for example, released from the holding elements 1 in groups or are processed in groups and conveyed onwards to a transfer point in any kind of order. For empty holding elements 1, a return track for transporting the holding elements back to the unit supplying the articles is to be provided. The unit supplying the articles and the unit taking over the articles (3 and 4) determine the conveying and buffering function of the present invention to a great degree. All the same, they are not part of this invention, the same as the return track for returning the empty holding elements 1.

Figure 2:
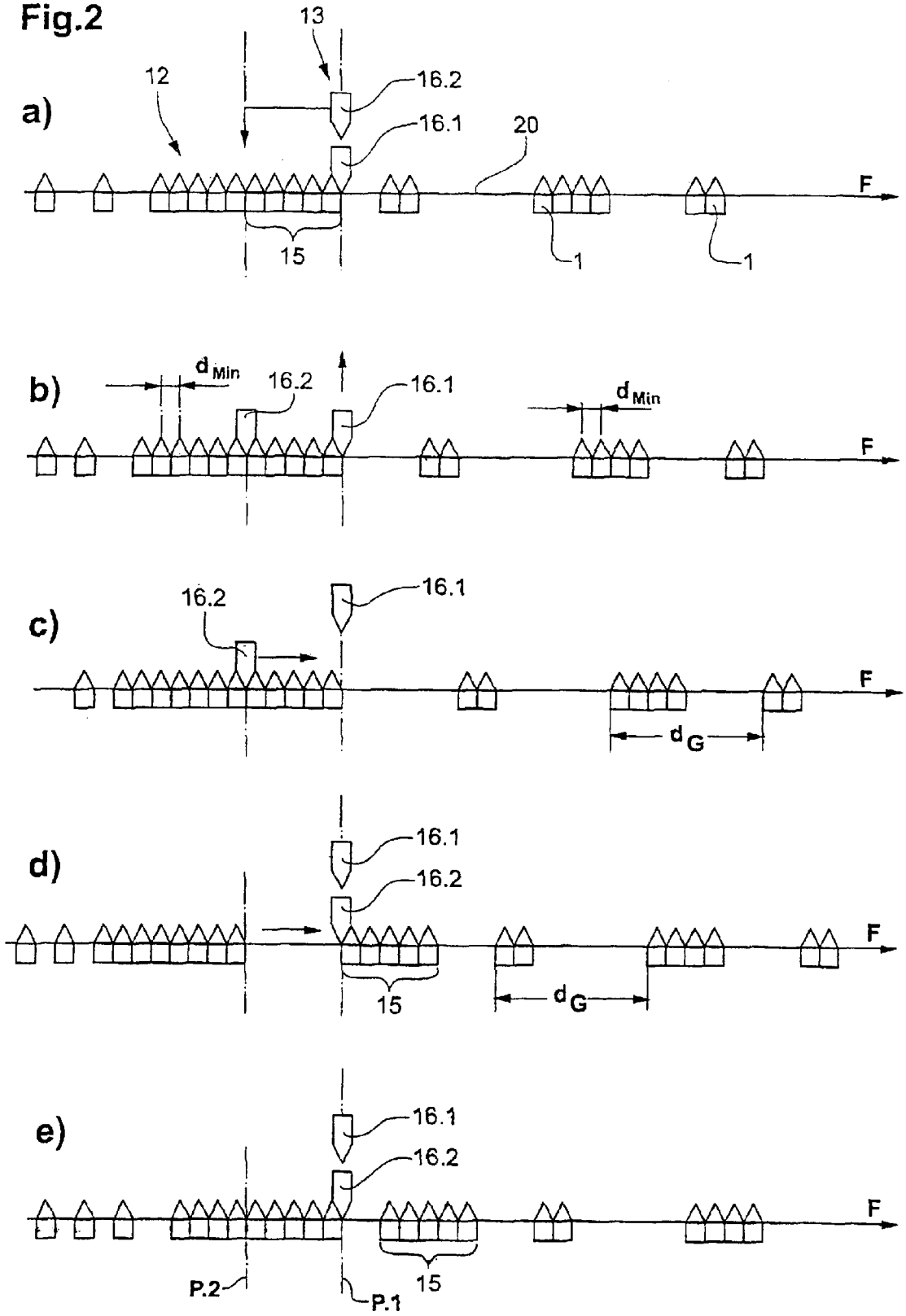
FIGS. 2 and 3 show the sequence of a group release for two exemplary embodiments of the method according to the invention.
Figure 3:
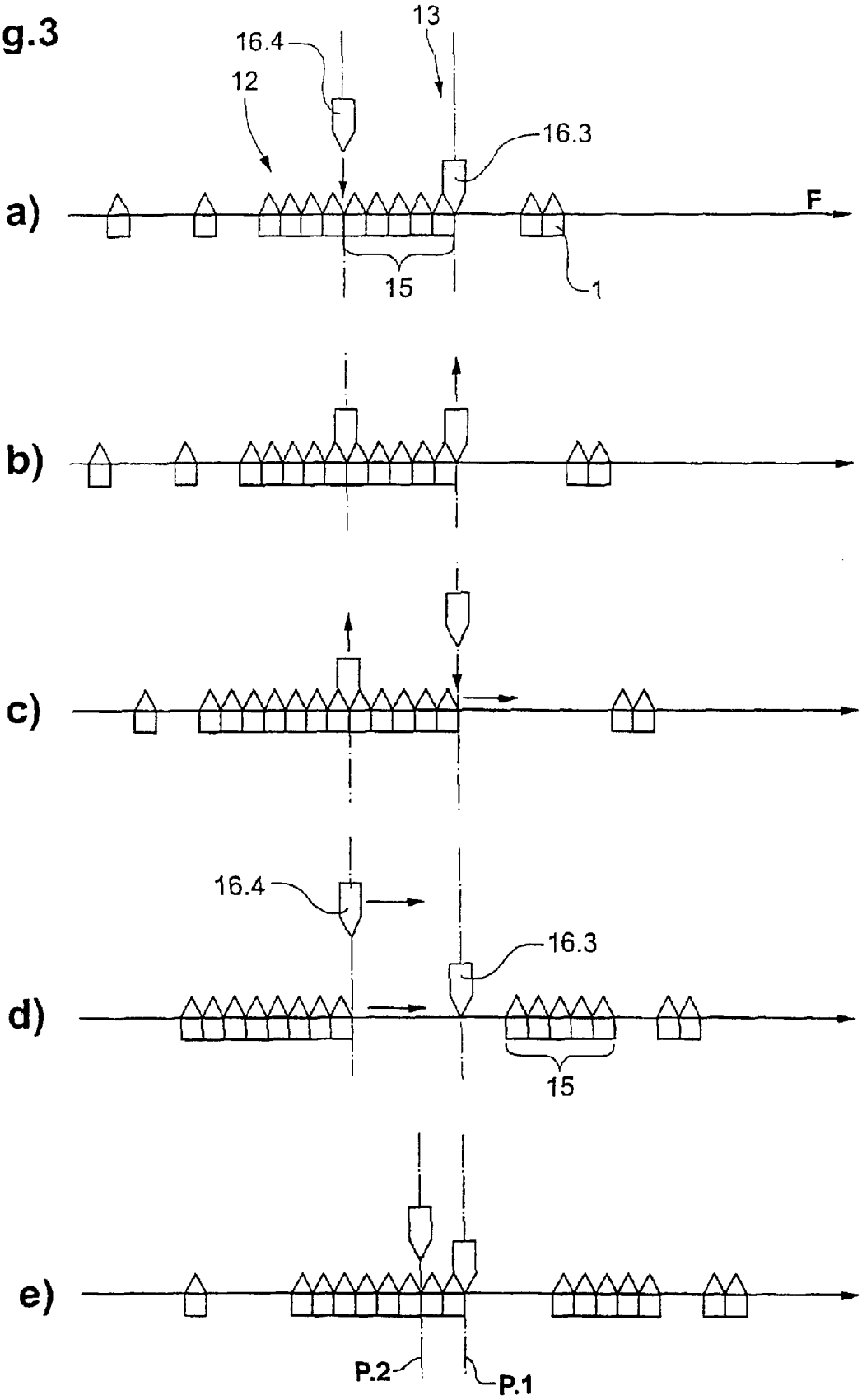

FIGS. 2 and 3 show very schematically two examples of pre-forming holding element groups 15 at the head 13 of the accumulation store system 12 and of group release and transfer to a conveying-away drive using the method according to the invention. Parts and functions, which have already been described in connection with FIG. 1, are designated with the same reference numbers.

FIG. 2 illustrates an accumulation store system 12 comprising two banking-up means 16.1 and 16.2 arranged at the head 13 of the system. The banking-up means define alternatingly a front banking-up point P.1 and a rear banking-up point P.2 (upstream of the front banking-up point P.1). The banking-up means 16.1 and 16.2 are movable parallel to the conveying direction F and are capable of being switched into an active configuration (with an effect on the conveying stream) and into an inactive configuration (without any effect on the conveying stream) and if so required they are also able to take over a conveying function.

FIG. 2 illustrates five process stages a) to e), which are passed through on release of a group 15 from the accumulation store 12. The group of holding elements 15 to be released consists of five holding elements 1 in the illustrated case. While the first banking-up means 16.1 is active in a first banking-up point P.1 and, as a result, banks up the supply and buffer stream, the second banking-up means 16.2 is activated in a rear banking-up point (a, b) for pre-forming the group 15. As soon as the group 15 is to be released, the first banking-up means 16.1 is de-activated (c) and the second banking-up means 16.2 is moved to the front banking-up point P.1 in active configuration (d) such pushing the group to be released forward. At the front banking-up point, the second banking-up means takes over the banking-up function, while the released group 15 is conveyed onwards from the banking-up point P.1. For forming and releasing a following group, the roles of the two banking-up means 16.1 and 16.2 are reversed.

For implementing the method illustrated in FIG. 2, different transportation drives can be utilized. The conveying-away drive has to be designed such that it is capable of taking over the whole group 15 pushed out of the accumulation store system by the banking-up means. Suitable drives for the supply and accumulation store conveyance are, for example, the force of gravity or a friction drive. For conveying-away, for example, a further or the same friction drive or else a group conveying means can be utilized. If conveying-away is realized with a friction drive, the speed of the banking-up means pushing-out the group needs to be at least as great as the conveying-away speed.

According to FIG. 2, the groups released from the accumulation store system 12 comprise differing numbers of holding elements 1 so that the position of the rear banking-up point P.2 and the stroke of the banking-up means parallel to the conveying direction vary according to the group size. The groups are released in a regular clocked cycle, wherein the distances $d_G$ between last holding elements of successive groups remain the same. Within the groups, the holding elements are arranged to have minimum distances $d_{Min}$ between one another.

For equal distances $d_G$ between the first holding elements of successive groups, every group needs to be pushed beyond the front banking-up point P.1 by the banking-up means (16.1 or 16.2) such that the first holding element of each group reaches a predetermined starting position. For the same purpose the pre-formed group can be coupled to the conveying-away drive already in a position behind the front banking-up point P.1 (front banking-up point equal to the predetermined starting point), i.e. being released from the accumulation store system through the effect of the conveying-away drive.

FIG. 3 illustrates, in the same manner as FIG. 2, a further embodiment of the method according to the invention. There is again a front banking-up means 16.3 and a rear banking-up means 16.4, both being capable of being switched into an active configuration and a rest configuration. In contrast to the variant according to FIG. 2, the two banking-up means 16.3 and 16.4 do not operate alternatingly at the front or rear banking-up point, but rather are fixedly assigned to one of the banking-up points P.1 or P2. For releasing groups of differing sizes, one (16.4) of the banking-up means is movable parallel to the conveying direction F. The banking-up means 16.3 and 16.4 do not take over a conveying function. Therefore, a drive covering the whole conveying track is necessary. However, in the supply zone and in the accumulation store, the function of this drive can be taken over by the force of gravity.

The release of a group 15 evolves in the following phases: the front banking-up means is active in the front banking-up point P.1, the rear banking-up means is positioned in the rear banking-up point P.2 and activated for forming the group 15 to be released (a, b); for releasing the group 15, the front banking-up means 16.3 is de-activated and the group is conveyed away (c); when the group has passed the front banking-up point, the front banking-up means 16.3 is re-activated, the rear banking-up means 16.4 is de-activated and, for the release of a next group it is, if so required, moved parallel to the conveying direction (d, e).

For releasing groups of differing sizes, it is also possible to move the front banking-up means 16.3 parallel to the conveying direction instead of the rear banking-up means 16.4; this signifies, that the front banking-up point P.1 has a variable position and the rear banking-up point P.2 is stationary. For releasing groups of a constant size, both banking-up points P.1 and P.2 are stationary.

Figure 4:
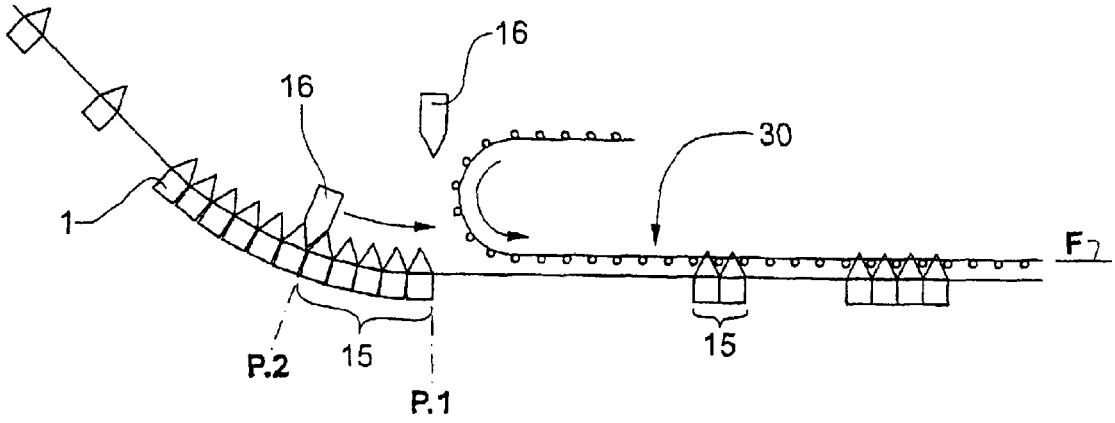
FIGS. 4 to 6 show schematic diagrams of different exemplary embodiments of the device in accordance with the invention.
Figure 5:
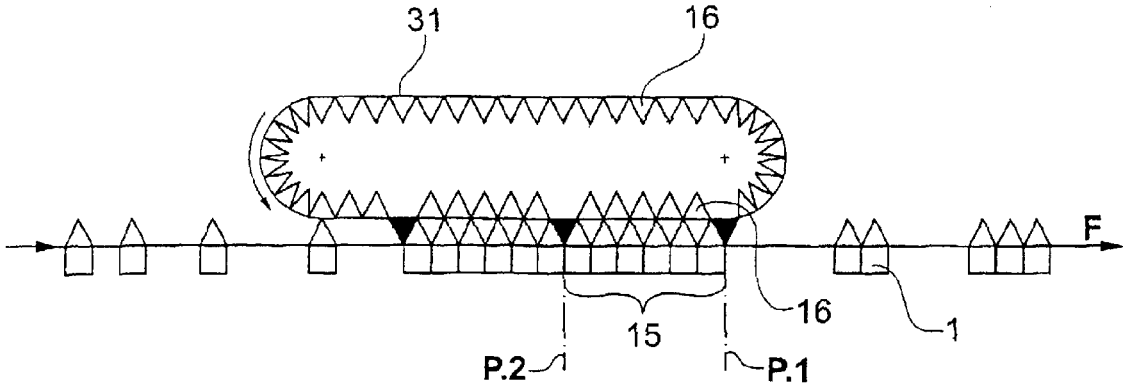
Figure 6:
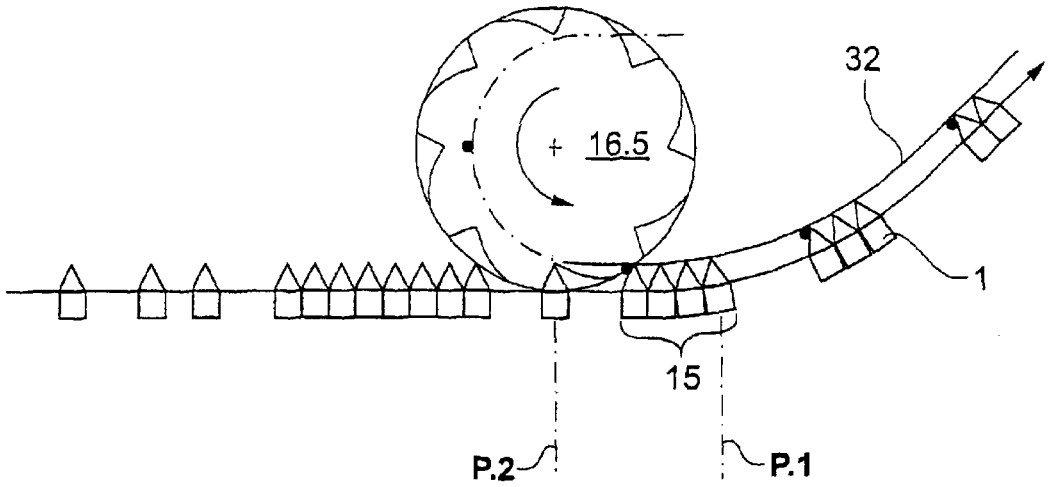

FIGS. 4 to 6 illustrate schematically some exemplary embodiments of the device according to the invention.

FIG. 4 depicts an embodiment according to FIG. 2 having two banking-up means 16 that operate alternatingly and that take on a conveying function when releasing groups. The force of gravity acts as supply drive and as buffer drive (stretch of rail sloping downwards towards the head of the accumulation store) and the conveying-away drive comprises a drag chain 30, the catches of which have a distance between one another that is matched to the minimum distance of the holding elements. The stroke of the banking-up means 16 parallel to the conveying direction F is designed such that a group to be released 15 is pushed so far beyond the front banking-up point P.1 that the last holding element of the group comes into the action range of the drag chain 30. The speed of this pushing-out stroke has to be the same as the speed of the drag chain 30.

FIG. 5 illustrates an embodiment with more than two banking-up means 16 being coupled to a circulating transport organ 31 (e.g., a chain) and having distances between one another that are matched to the minimum distances of the holding elements. The banking-up means can be selectively switched into an active configuration (depicted in black) or into a rest configuration (depicted in white). The function of the banking-up means 16 is substantially the same as the function of the alternating banking-up means 16.1 and 16.2 according to FIG. 2. However, for pre-forming groups of differing sizes banking-up means are not correspondingly positioned, but rather a correspondingly selected banking-up means is activated (the distance between two active banking-up means is equal to the length of a group to be released). With the device according to FIG. 5, it is also possible to have more than two banking-up means in an active condition, i.e. it is possible to pre-form more than one group to be released 15. The transportation organ 31 is driven in a controlled manner such that for releasing a group it moves by the length of the group in the direction indicated and pushes out the group to be released. It stands still between releases. The banking-up means may be flexibly joined together as a chain and driven by pushing one another in the zone of the accumulation store. For a group release, the foremost active banking-up means is de-activated and the second foremost accelerated in a controlled manner to be moved to the front banking-up point P.1.

FIG. 6 illustrates an embodiment of the device in accordance with the invention, in which the function of the front banking-up means is taken over by the force of gravity. Therefore, the front banking-up point P.1 being non-stationary (passive banking-up point) is very easily implemented. The rear banking-up means is a stationary timing wheel 16.5. The conveying-away drive is a group conveying means, for example, a drag chain 32, the catches of which have a distance between one another that is at least as great as the length of the longest group to be anticipated. The timing wheel 16.5 pre-forms the groups, in that it rotates intermittently and counts off the holding elements 1 necessary for a group to be released. Through the force of gravity, the counted-off holding elements remain banked-up (passive banking-up point P.1) and are conveyed away by the next catch of the drag chain 32. They may also be actively coupled to a correspondingly equipped drive. As soon as a counted-off group has been conveyed away by the catch assigned to it, the timing wheel 16.5 starts counting out holding elements for the next group. The supply drive and buffer drive is, for example, a friction drive. It is also conceivable, that the stretch of rail slopes downwards towards the timing wheel 16.5 and the holding elements are fed-into the accumulation store and pushed against the timing wheel 16.5 by the force of gravity.

In the embodiment of the invention according to FIG. 6, a single banking-up means may be utilized instead of the timing wheel 16.5. This single banking-up means is controlled such that between its de-activation and further activation a group is pre-formed (or counted-off), i.e., is conveyed beyond the stationary banking-up point P.2. If there is no need for the distances within a pre-formed group to correspond very accurately to the minimum distance, friction between the stretch of rail and the holding means may function as banking-up means in the variable, passive banking-up point P.1 in place of the force of gravity. In such a case, the stretch of rail downstream of P.1 may also have a horizontal course.

Figure 7:
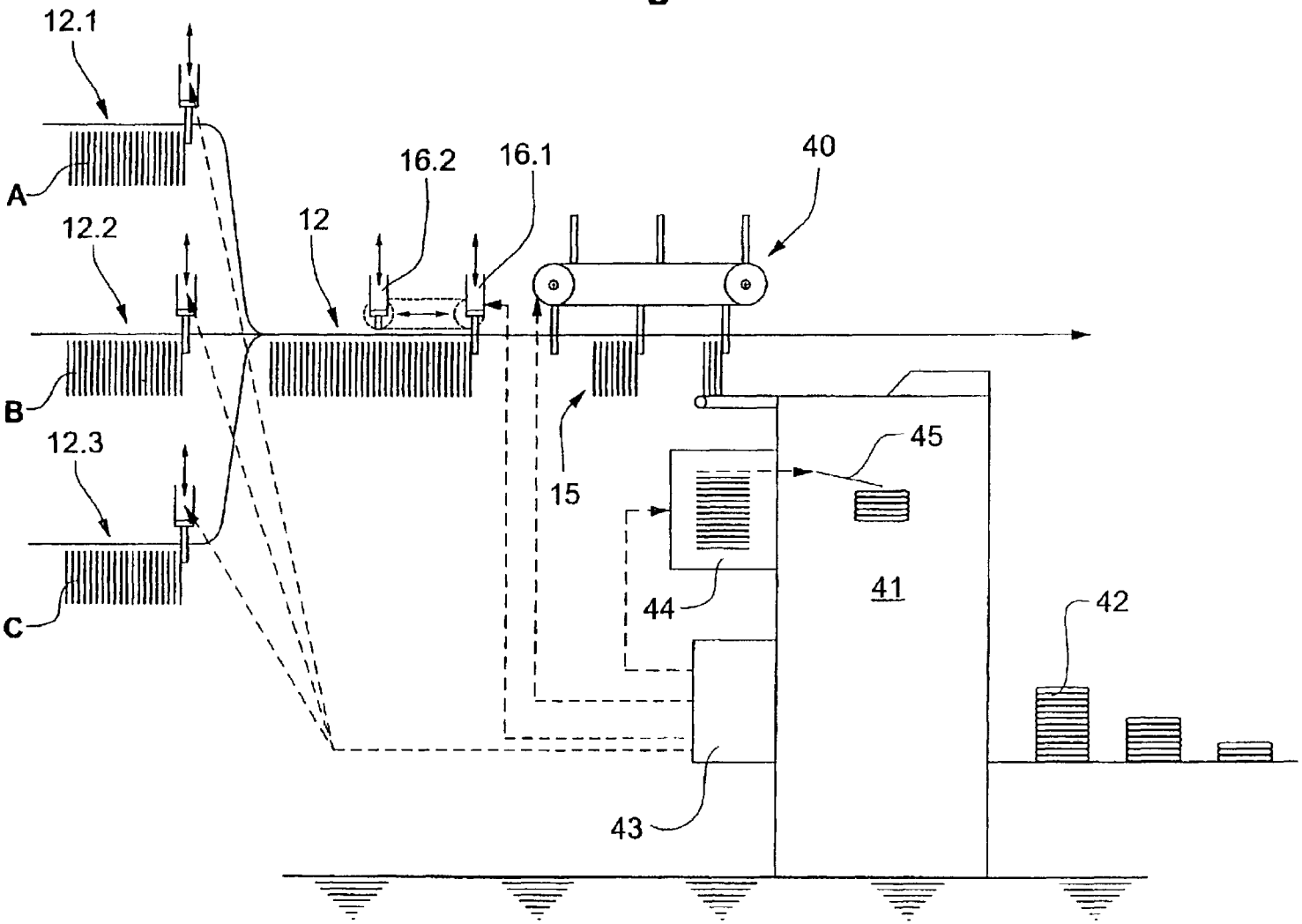
FIGS. 7 and 8 show examples of applications for the method according to the invention and for the device according to the invention.
Figure 8:
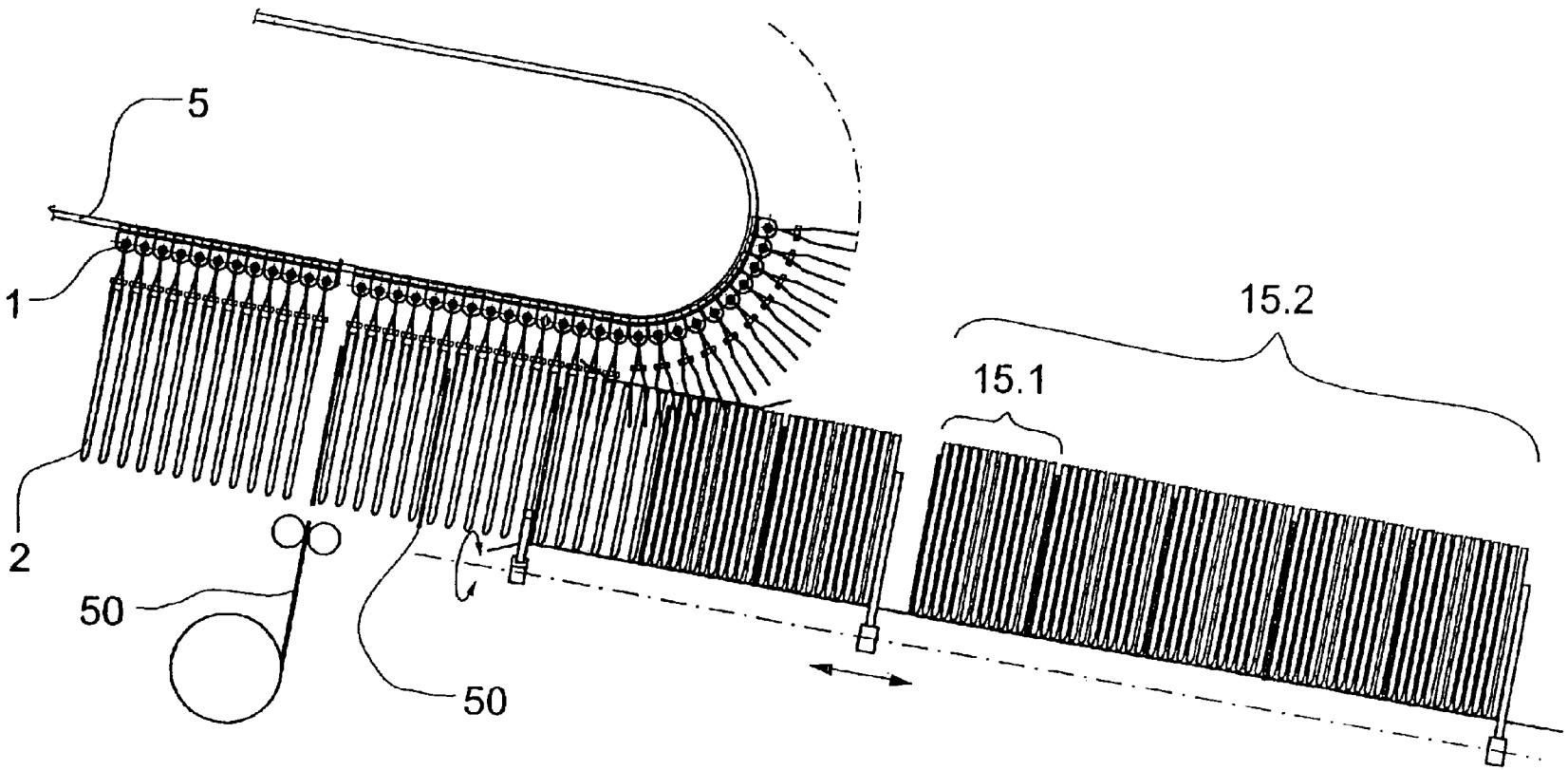

FIGS. 7 and 8 depict two examples concerning the application of the method and device in accordance with the invention or concerning further processing of group streams established according to the method of the invention, respectively.

FIG. 7 shows in a very schematic manner a double accumulation store with group release. The depicted installation serves for producing a predefined sequence of packages, which all contain differing predefined numbers of printed products of the type A, B and C (newspapers or periodicals). The printed products of the types A, B and C are transported along different conveying tracks to accumulation store 12.1, 12.2, 12.3, while being individually gripped and driven, for example, by the force of gravity. From the accumulation store the printed products are released into a central accumulation store 12 either in groups (according to the invention) or individually (according to the prior art), such that they are pre-mixed in the central accumulation store 12 according to the sequence of packages to be established. At least the accumulation store 12 operates according to the method of the invention, i.e., the products available in the accumulation store 12 in pre-mixed form are pre-formed into groups 15 in the accumulation store, each group representing a package. The pre-formed groups are released from the accumulation store 12 and are transferred to a group conveyor 40. For pre-forming and releasing the groups, two alternating banking-up means 16.1 and 16.2 as described in association with FIG. 2 are provided. The group conveyor 40 conveys the groups 15 of the still individually held products into a packaging machine 41 for processing the groups fed-in by the group conveyor 40 into packages 42, for example, by cross-stacking and strapping or enveloping and for example, in a regularly clocked manner.

A control unit 43 controls the packaging machine 41, synchronises the group conveying means 40 with the packaging machine 41 and controls the accumulation stores 12.1, 12.2, 12.3, and 12 in accordance with a predefined package sequence and the predefined package contents. A device 44 integrated in the packaging machine 41 and serving for printing and positioning cover sheets 45 may also be controlled by the control unit 43.

FIG. 8 illustrates a double accumulation store and group formation. This is utilized for banking-up printed products 2 supplied in a held manner by holding elements 1 in an accumulation store, for releasing them from the accumulation store in the form of sections 15.1 (groups of products), and for inserting a separating sheet 50 between each two sections 15.1. The sections 15.1 are then again banked-up and released in the form of package stacks 15.2 (group of sections), wherein the stacks may contain differing numbers of sections 15.1. These stacks may be supplied to a packaging machine in the same manner as illustrated in FIG. 7.

What is claimed is:

1. A method for transporting and buffering articles (2) comprising the steps of:

providing a rail (5);

providing a plurality of holding elements (1);

transporting the holding elements (1) one behind the other along a stretch of the rail (5), wherein each holding element (1) holds an article (2) in a defined position, and wherein the holding elements (1) are conveyed in a conveying direction (F) along a conveying track defined by the stretch of rail (5), banking up the holding elements (1) during transport to form an accumulation store (12) upstream of a front banking-up point (P.1), wherein the accumulation store (12) comprises, in addition to the front banking-up point (P.1) and upstream thereof, a rear banking-up point (P.2) and wherein the banked-up holding elements (1) have a defined minimum distance ($d_{Min}$) between one another, in the accumulation store (12), pre-forming groups of holding elements (15) between the front banking-up point (P.1) and the rear banking-up point (P.2), wherein each group comprises a plurality of holding elements (15), releasing the groups of holding elements (15) from the accumulation store (12), wherein in each released group the holding elements (15) are spaced apart the defined minimum distance ($d_{Min}$), and conveying away the released groups of the holding elements (15), and wherein the groups of the holding elements (1) preformed in the accumulation store, released from the accumulation store, and conveyed away from the accumulation store in succession comprise varying numbers of the holding elements (1), wherein a distance between the front banking-up point and the rear banking-up point (P.1 and P.2) corresponds to a length in the conveying direction of a group (15) to be released, and wherein, for pre-forming or releasing the groups, one of the banking-up points (P.1 or P.2) is stationary and the other banking-up point (P.2 or P.1) is displaced parallel to the conveying direction.

2. The method according to claim 1, wherein the groups of the holding elements (15) are pre-formed and released from the accumulation store (12) using first and second banking-up means (16, 16.1, 16.2, 16.3, 16.4, 16.5), wherein the first banking-up means acts at the front banking-up point (P.1) and the second banking-up mean acts at the rear banking-up point (P.2).

3. The method according to claim 2, wherein at least one of the first and second banking-up means (16.1, 16.2, 16.4) is displaced parallel to the conveying direction (F) between successive releases.

4. The method according to claim 2, wherein groups (15) are pushed out of the accumulation store (12) by the second banking-up means (16.2).

5. A method for conveying articles along a conveying path, for stopping the articles being conveyed, for establishing a buffer store on the conveying path, for releasing the articles from the buffer store in groups of a plurality of the articles each, and for conveying away the groups, wherein each article is held by a holding element and the holding elements within each group are spaced from each other by a defined minimum spacing, the method comprising the steps of:

providing a rail track along the conveying path;

providing a plurality of holding elements that are displaceable behind each other and are independent from each other, said holding elements having a predetermined minimum spacing;

moving the holding elements along the rail track;

defining along the rail track a front banking-up point and a rear banking-up point upstream of the front banking-up point;

selectively buffering the holding elements behind the front banking-up point or the rear banking-up point, or moving the holding elements past the front banking-up point or the rear banking-up point, said buffering or moving being performed in the following steps:

(a.) buffering the holding elements behind the front banking-up point and moving the holding elements past the rear banking-up point;

(b.) for forming a group of the holding elements between the front banking-up point and the rear banking-up point, buffering the holding elements behind the front banking-up point and the rear banking-up point;

c) for releasing the group formed between the front banking-up point and the rear banking-up point to be conveyed away, downstream, moving the holding elements past the front banking-up point and buffering the holding elements behind the rear banking-up point; and d) repeating steps a) to c) for every successive group; and wherein for forming groups of varying numbers of the holding elements, the distance between the front banking-up point and the rear banking-up point is varied.

6. The method of claim 5, wherein the holding elements are acted on by banking-up means at the front banking-up point and the rear banking-up point for pre-forming and releasing the groups.

7. The method of claim 6, wherein for varying the distance between the front banking-up point and the rear banking-up point, the banking-up means is displaced parallel to the rail track.

8. The method of claim 5, wherein banking-up means acting on the rear banking-up point is displaced parallel to the rail track for pushing the formed group to move past the front banking-up point.

9. The method of claim 5, wherein a first banking-up means and a second banking-up means act alternately at the front banking-up point and at the rear banking-up point.

10. The method of claim 5, wherein a plurality of banking-up means are displaceable parallel to the rail track and act alternately at the front banking-up point and at a plurality of rear banking-up points.

11. The method of claim 10, wherein the plurality of banking-up means are displaced parallel to the rail track by being arranged on a circulating transport organ.

12. The method of claim 5, wherein at least one banking-up means is fixedly disposed at the front banking-up point or the rear banking-up point.

13. The method of claim 12, wherein the at least one banking-up means comprises a first banking-up means acting at the first banking-up point and a second banking-up means acting at the second banking-up point, said first banking-up means comprising gravity, friction or momentary absence of driving force, and said second banking-up means being fixedly disposed at the second banking-up point.

14. The method of claim 13, wherein the second banking-up means comprises a timing wheel (16.5).

15. The method of claim 5, wherein, for being supplied to the accumulation store (12), for being transported through the accumulation store (12) to the front banking-up point (P.1), and for being conveyed-away from the front banking-up point (P.1), the holding elements (1) are coupled to a single drive, wherein banked-up holding elements slip relative to the drive or are uncoupled from it.

16. The method of claim 5, wherein, for being supplied to the accumulation store (12) and/or for being transported though the accumulation store (12) to the front banking-up point (P.1) or to the rear banking-up point (P.2), the holding elements (1) are driven by gravity.

17. The method of claim 5, wherein the articles are printed articles.

18. A device for conveying articles along a conveying path, for stopping the articles being conveyed, for establishing a buffer store on the conveying path, for releasing the articles from the buffer store in groups of a plurality of the articles each, and for conveying away the groups, wherein each article is held by a holding element and the holding elements within each group are spaced from each other by a defined minimum spacing, the device comprising:

a rail track along the conveying path;

a plurality of holding elements that are displaceable behind each other and are independent from each other, said holding elements having a predetermined minimum spacing;

driving means for moving the holding elements along the rail track;

at least two banking-up means arranged for acting at a front banking-up point and a rear banking-up point along the rail track, said rear banking-up point being positioned upstream of the front banking-up point, said at least two banking-up means being operable to selectively buffer the holding elements behind the front banking-up point or the rear banking-up point, or move the holding elements past the front banking-up point or the rear banking-up point; and control means for controlling the at least two banking-up means in the following steps:

(a.) buffering the holding elements behind the front banking-up point and moving the holding elements past the rear banking-up point;

(b.) for forming a group of the holding elements between the front banking-up point and the rear banking-up point, buffering the holding elements behind the front banking-up point and the rear banking-up point;

c) for releasing the group formed between the front banking-up point and the rear banking-up point to be conveyed away, downstream, moving the holding elements past the front banking-up point and buffering the holding elements behind the rear banking-up point; and d) repeating steps a) to c) for every successive group; and wherein for forming groups of varying numbers of the holding elements, at least one of the two banking-up means is displaceable parallel to the rail track; and wherein the control means is operable to move the displaceable banking-up means between the formation of successive groups.

19. The device of claim 18, wherein said at least two banking-up means comprises a first banking-up means arranged to act at the front banking-up point and a second banking-up means arranged to act at the rear banking-up point, and wherein one of the first and second banking-up means is displaceable parallel to the rail track .

20. The device of claim 18, wherein said at least two banking-up means (16) are capable of being selectively activated and are coupled to a circulating transportation organ (31).

21. The device of claim 18, wherein said at least two banking-up means comprise a second banking-up means, which is disposed at the rear banking-up point (P.2) and is stationary, and wherein for banking-up at the front banking-up point (P.1), the rail track and the drive means are designed such that a group pre-formed between the front banking-up point and the rear banking-up point is either selectively conveyed away or is banked-up by not being conveyed away.

22. The device of claim 21, wherein the rail track rises from the rear banking-up point to the front banking-up point so that gravity acts as a first banking-up means at the front banking-up point (P.1).

23. The device of claim 21, wherein the second banking-up means disposed at the rear banking-up point (P.2) is a timing wheel (16.5).

24. The device of claim 18, wherein the drive means comprises a slip drive disposed at least between the front banking-up point and the rear banking-up point.

25. The device of claim 24, wherein the slip drive and the holding elements are equipped for magnetic coupling of the holding elements to the slip drive.

26. The device of claim 18, wherein in a gravity zone of the rail track in the conveying direction (F), at least upstream of the front banking-up point (P.1), the rail track drops, wherein, in the gravity zone of the rail track, gravity acts as the drive means.

* * * * *